US009080225B2

(12) United States Patent
Kim et al.

(10) Patent No.: US 9,080,225 B2
(45) **Date of Patent: *Jul. 14, 2015**

(54) ALUMINUM ALLOY AND MANUFACTURING METHOD THEREOF

(75) Inventors: Shae-Kwang Kim, Seoul (KR); Jin-Kyu Lee, Incheon (KR); Min-Ho Choi, Chungcheongbuk-do (KR); Young-Ok Yoon, Incheon (KR)

(73) Assignee: KOREA INSTITUTE OF INDUSTRIAL TECHNOLOGY, Cheonan (KR)

( * ) Notice: Subject to any disclaimer, the term of this patent is extended or adjusted under 35 U.S.C. 154(b) by 889 days.

This patent is subject to a terminal disclaimer.

(21) Appl. No.: 12/949,061

(22) Filed: Nov. 18, 2010

(65) Prior Publication Data

US 2011/0123391 A1 May 26, 2011

(30) Foreign Application Priority Data

Nov. 20, 2009 (KR) ..... 10-2009-0112872
Jul. 13, 2010 (KR) ..... 10-2010-0067503

(51) Int. Cl.

| | |
|---|---|
| ***B22D 27/00*** | (2006.01) |
| ***C22C 1/03*** | (2006.01) |
| ***C22C 21/00*** | (2006.01) |
| ***C22C 1/02*** | (2006.01) |
| ***C22C 21/02*** | (2006.01) |
| ***C22C 21/06*** | (2006.01) |
| ***C22C 21/08*** | (2006.01) |
| ***C22C 21/16*** | (2006.01) |

(52) U.S. Cl.

CPC ... *C22C 1/03* (2013.01); *C22C 1/02* (2013.01); *C22C 21/00* (2013.01); *C22C 21/02* (2013.01); *C22C 21/06* (2013.01); *C22C 21/08* (2013.01); *C22C 21/16* (2013.01)

(58) Field of Classification Search

CPC ..... B22D 27/00; C22C 1/02; C22C 1/03; C22C 21/00; C22C 21/06

USPC ..... 164/55.1, 57.1; 420/590

See application file for complete search history.

(56) References Cited

U.S. PATENT DOCUMENTS

| | | | | |
|---|---|---|---|---|
| 3,567,429 | A * | 3/1971 | Dunkel et al. | 75/10.18 |
| 4,286,984 | A * | 9/1981 | Luyckx | 75/303 |
| 4,929,511 | A * | 5/1990 | Bye et al. | 428/606 |
| 2008/0187454 | A1* | 8/2008 | Tanizawa et al. | 420/407 |
| 2011/0123390 | A1* | 5/2011 | Kim et al. | 420/532 |

* cited by examiner

*Primary Examiner* — Kevin P Kerns

(57) ABSTRACT

Provided are an aluminum alloy and a manufacturing method thereof. In the method, aluminum and a magnesium (Mg) master alloy containing a calcium (Ca)-based compound are provided. A melt is prepared, in which the Mg master alloy and the Al are melted. The aluminum alloy may be manufactured by casting the melt.

22 Claims, 6 Drawing Sheets

(a)

(b)

(a)

(b)

ALUMINUM ALLOY AND MANUFACTURING METHOD THEREOF

CROSS-REFERENCE TO RELATED PATENT APPLICATION

This application claims the benefit of Korean Patent Application Nos. 10-2009-0112872 filed on Nov. 20, 2009 and 10-2010-0067503 filed on Jul. 13, 2010 in the Korean Intellectual Property Office, the disclosure of which is incorporated herein in its entirety by reference.

BACKGROUND

1. Field of the Invention

The present invention relates to an aluminum alloy and a manufacturing method thereof.

2. Description of the Related Art

Magnesium (Mg) is currently one of the main alloying elements in an aluminum (Al) alloy. The addition of Mg increases the strength of aluminum alloy, makes the alloy favorable to surface treatment, and improves corrosion resistance. However, there is a problem that the quality of a molten aluminum may be deteriorated due to the fact that oxides or inclusions are mixed into the molten aluminum during alloying of magnesium in the molten aluminum because of a chemically high oxidizing potential of magnesium. In order to prevent oxides or inclusions from being mixed into the molten aluminum due to the addition of magnesium, a method of covering the melt surface with a protective gas such as $SF_6$ may be used during the addition of magnesium.

However, it is difficult to perfectly protect magnesium, which is massively added during the preparation of an aluminum alloy, using a protective gas. Furthermore, $SF_6$ used as the protective gas is not only an expensive gas but also a gas causing an environmental problem, and thus the use of $SF_6$ is now being gradually restricted all over the world.

SUMMARY OF THE INVENTION

The present invention provides an aluminum alloy which is manufactured in an environment-friendly manner and has excellent alloy properties, and a manufacturing method of the aluminum alloy. Also, the present invention provides a processed product using the aluminum alloy.

According to an aspect of the method, there is provided a method of manufacturing an aluminum (Al) alloy. A master alloy containing a calcium (Ca)-based compound and aluminum are provided. A melt is formed in which the master alloy and the aluminum are melted. The melt is casted. The master alloy is formed by adding a calcium (Ca) into a parent material.

According to another aspect of the method, the parent material may include pure magnesium, a magnesium alloy, pure aluminum or an aluminum alloy, and the magnesium alloy may include aluminum as an alloying element.

According to another aspect of the method, the method may further include adding iron (Fe) in an amount less than or equal to about 1.0% by weight (more than 0%).

According to another aspect of the method, manufacturing the master alloy may include forming a molten parent material by melting the parent material and adding the calcium into the molten parent material.

According to another aspect of the method, manufacturing the master alloy may include melting the parent material and the calcium together.

According to another aspect of the method, the parent material may include at least one of magnesium and aluminum, and the calcium-based compound may include at least one of a Mg—Ca compound, an Al—Ca compound and a Mg—Al—Ca compound. Further, the Mg—Ca compound may include $Mg_2Ca$, the Al—Ca compound may include at least one of $Al_2Ca$ and $Al_4Ca$, and the Mg—Al—Ca compound may include $(Mg, Al)_2Ca$.

According to another aspect of the method, there is provided a method of manufacturing an aluminum (Al) alloy. Calcium and aluminum are provided. A melt is formed in which the calcium and the aluminum are melted. The melt is casted. The calcium is added in an amount between 0.1 and 40% by weight in the Al alloy.

An aluminum alloy according to an aspect of the present invention may be an aluminum alloy which is manufactured by the method according to any one of the above-described methods.

An aluminum alloy according to an aspect of the present invention may include an aluminum matrix; and a calcium-based compound existing in the aluminum matrix, wherein calcium is dissolved in an amount less than a solubility limit in the aluminum matrix.

According another aspect of the aluminum alloy, the aluminum alloy may include iron (Fe) less than or equal to 1.0% by weight.

According to another aspect of the aluminum alloy, the aluminum matrix may have a plurality of domains which form boundaries therebetween and are divided from each other, wherein the calcium-based compound exists at the boundaries. For example, the domains may be grains, and the boundaries may be grain boundaries. For another example, the domains may be phase regions defined by phases different from each other, and the boundaries may be phase boundaries.

According to another aspect of the aluminum alloy, the aluminum matrix may have a plurality of domains which form boundaries therebetween and are divided from each other, wherein the calcium-based compound may exist within the domains.

An aluminum alloy according to another aspect of the present invention may include an aluminum matrix wherein calcium is dissolved up to a solubility limit; and a calcium-based compound existing within the aluminum matrix, wherein an amount of calcium in the aluminum matrix is between 0.1 and 40% by weight.

According to another aspect of the aluminum alloy, wherein the aluminum alloy has the domains in average size smaller than other aluminum alloy not having the calcium-based compound which is manufactured under the same conditions.

According to another aspect of the aluminum alloy, the aluminum alloy has tensile strength greater than that of other aluminum alloy not having the calcium-based compound which is manufactured under the same conditions.

BRIEF DESCRIPTION OF THE DRAWINGS

The above and other features and advantages of the present invention will become more apparent by describing in detail exemplary embodiments thereof with reference to the attached drawings.

DETAILED DESCRIPTION OF THE INVENTION

Hereinafter, the present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art.

According to an embodiment of the present invention, a master alloy with calcium (Ca) added as an additive is prepared, and thereafter an aluminum alloy is manufactured by adding the master alloy into aluminum. The master alloy may include a magnesium master alloy formed by using pure magnesium or magnesium alloy as parent material, and an aluminum master alloy formed by using pure aluminum or aluminum alloy as parent material.

In this embodiment, pure magnesium or pure aluminum, into which alloying elements have not been added intentionally, is defined to encompass magnesium or aluminum which contain impurities unavoidably introduced during the manufacture of the magnesium or aluminum. On the contrary, a magnesium alloy or an aluminum alloy is an alloy manufactured by intentionally adding other alloying elements into magnesium or aluminum, respectively. A magnesium alloy containing aluminum as an alloying element may be called a magnesium-aluminum alloy. This magnesium-aluminum alloy may include other alloying elements as well as aluminum as an alloying element.

Figure 1:
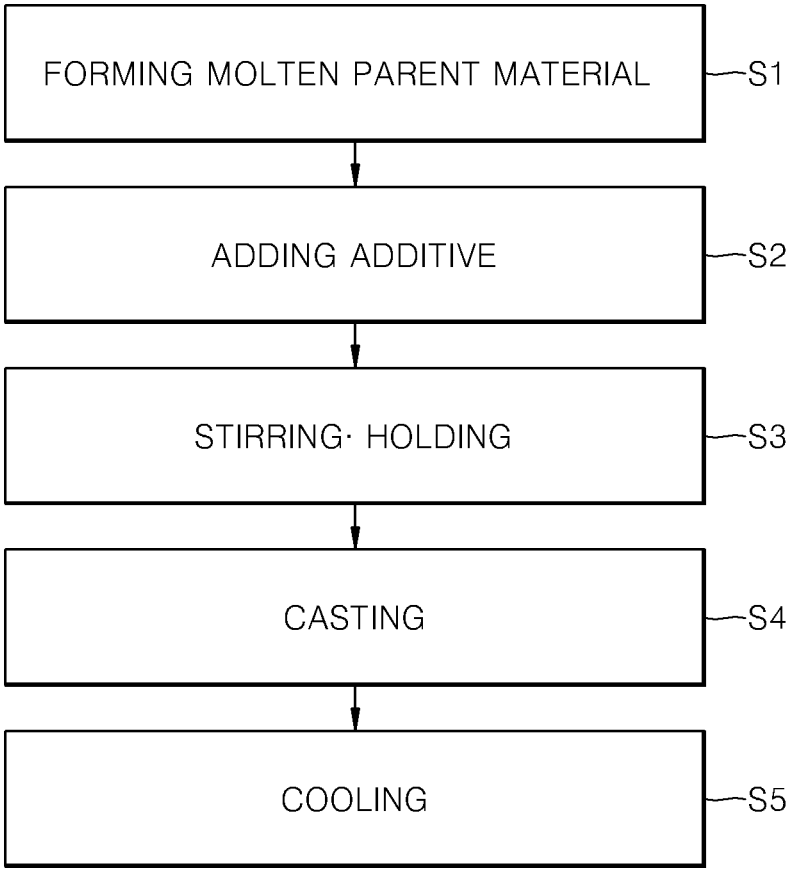
FIG. 1 is a flowchart illustrating an embodiment of a method of manufacturing a magnesium master alloy to be added into a molten aluminum during the manufacture of an aluminum alloy according to embodiments of the present invention.

FIG. 1 is a flowchart showing a manufacturing method of a master alloy according to an embodiment of the present invention.

Referring to FIG. 1, the manufacturing method of master alloy includes a molten parent material forming operation S1, an additive adding operation S2, a stirring holding operation S3, a casting operation S4, and a cooling operation S5.

In the molten parent material forming operation S1, a parent material is placed into a crucible and a molten parent material is formed by heating the crucible. For example, magnesium or magnesium alloy as a parent material is put into the crucible and a molten magnesium is formed by heating the crucible. For instance, magnesium may be melted by heating the crucible at a temperature ranging from about 600° C. to about 800° C. When a heating temperature is less than about 600° C., it is difficult to form molten magnesium. On the contrary, when the heating temperature is more than about 800° C., there is a risk that the molten magnesium may be ignited.

As another example, aluminum or aluminum alloy as a parent material is placed into the crucible and a molten aluminum is formed by heating the crucible at a temperature ranging from about 600° C. to about 900° C.

In the additive adding operation S2, calcium (Ca) as an additive is added into the molten parent material.

In the stirring•holding operation S3, the molten parent material is stirred or held for an appropriate time. For example, the stirring or holding time may be in the range of from about 1 to about 400 minutes. If the stirring•holding time is less than about 1 minute, the additive is not fully mixed in the molten parent material, and if it is more than about 400 minutes, the stirring•holding time of the molten parent material may be lengthened unnecessarily.

Ca in an amount between about 0.0001 and about 100 parts by weight, preferably between 0.001 and 30 parts by weight may be added based on 100 parts by weight of the parent material. In the case where the additive is less than about 0.0001 parts by weight, the effects caused by the additive (e.g., hardness increase, oxidation decrease, ignition temperature increase and protective gas decrease) will be relatively small. Also, the Ca-based compound in the master alloy can be diluted during adding into the aluminum alloy, with the result that the content of the master alloy decreases as the amount of Ca added into the master alloy increases. When the amount of Ca is more than about 100 parts by weight, it is difficult to fabricate the master alloy. In consideration of this difficulty, the amount of Ca may be less than or equal to about 30 parts by weight in consideration of the difficulty of fabrication.

Meanwhile, in the case where pure magnesium or magnesium alloy is used as the parent material to form the master alloy, a small amount of a protective gas may be optionally provided in addition in order to prevent the molten magnesium from being ignited. The protective gas may use typical $SF_6$, $SO_2$, $CO_2$, HFC-134a, Novec™ 612, inert gas, equivalents thereof, or gas mixtures thereof. However, this protective gas is not always necessary in the present invention, and thus may not be provided.

As described above, when Ca is input in the additive adding operation S2 and/or the stirring•holding operation S3, the amount of the protective gas required in melting of magnesium may be considerably reduced or eliminated because the ignition temperature is increased by increasing the oxidation resistance of magnesium in the melt. Therefore, according to the manufacturing method of the magnesium master alloy, environmental pollution can be suppressed by eliminating or reducing the use amount of the protective gas such as $SF_6$ or the like.

After the stirring•holding operation S3 of the molten parent material is completed, the molten magnesium is cast in a mold in operation S4, cooled down, and then a solidified master alloy is separated from the mold in operation S5.

A temperature of the mold in the casting operation S4 may be in the range of from about room temperature (for example, about 25° C.) to about 400° C. In the cooling operation S5, the master alloy can be separated from the mold after the mold is cooled to a room temperature; however, the master alloy can also be separated even before the temperature reaches to the room temperature if the master alloy is mostly solidified.

Herein, the mold can be selected from a metallic mold, a ceramic mold, a graphite mold, and equivalents thereof. Also, the casting method may include sand casting, die casting, gravity casting, continuous casting, low-pressure casting, squeeze casting, lost wax casting, thixo casting or the like.

Gravity casting denotes a method of pouring a molten alloy into a mold by using gravity, and low-pressure casting denotes a method of pouring a melt into a mold by applying a pressure to the surface of the molten alloy using a gas. Thixo casting, which is a casting process performed in a semi-solid state, is a combination method which adopts the advantages of typical casting and forging processes. However, the present invention is not limited to a mold type and a casting method or process.

The prepared magnesium master alloy can have a matrix having a plurality of domains with boundaries therebetween, which are divided from each other. For example, the domains can comprise a plurality of grains which are divided by grain boundaries. For another example, the domains can comprise a plurality of phase regions, wherein the phase regions are defined by phase boundaries therebetween.

Meanwhile, a calcium-based compound formed during the manufacturing process of the master alloy can be dispersed in the matrix of the master alloy. This calcium-based compound can be formed through the reaction of Ca added in the additive adding operation S2 with other elements, for example magnesium and/or aluminium in the parent material.

For example, where the parent material is pure magnesium or magnesium alloy, Ca can react with magnesium so as to form Mg—Ca compound such as $Mg_2Ca$. For another example, where the parent material is pure aluminum or aluminum alloy, Ca reacts with aluminum so as to form an Al—Ca compound such as $Al_2Ca$ or $Al_4Ca$.

In the case where the parent material of the magnesium master alloy is a magnesium-aluminum alloy, Ca reacts with magnesium and/or aluminum so as to form at least one of a Mg—Ca compound, an Al—Ca compound, and a Mg—Al—Ca compound. For instance, the Mg—Ca compound can be $Mg_2Ca$, the Al—Ca compound can include at least one of $Al_2Ca$ and $Al_4Ca$, and the Mg—Al—Ca compound can be $(Mg, Al)_2Ca$.

It is highly probable that the Ca-based compound is distributed at grain boundaries, i.e., boundaries between grains, or phase boundaries, i.e., boundaries between phase regions. This is because such boundaries have substantially open structures and have relatively high energy compared to inside regions of the grains or phase regions, and therefore such boundaries are favorable sites for nucleation and growth of the Ca-based compound.

Figure 2:
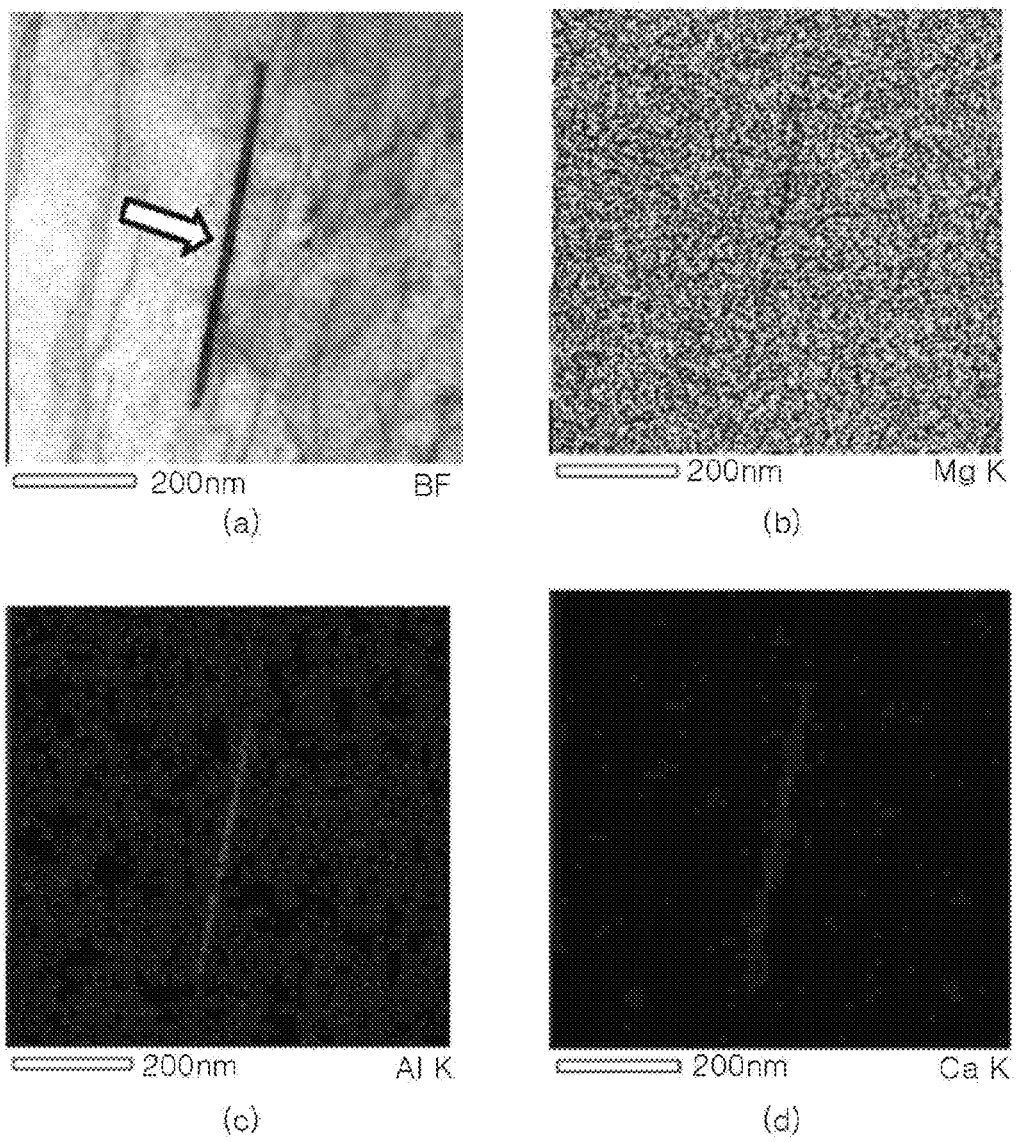
FIG. 2 shows analysis results of components of Ca-based compounds in a magnesium master alloy.

FIG. 2 represents TEM (transition electron microscope) analysis results of the magnesium master alloy which is manufactured by adding Ca into the Mg—Al alloy of the parent material.

FIG. 2(*a*) shows a microstructure of the magnesium master alloy observed in a BF mode and FIGS. 2(*b*) through 2(*d*) show the components of the compound region mapped by TEM, that is, TEM images showing distribution areas of magnesium (b), aluminum (c) and calcium (d), respectively.

Referring to FIGS. 2(*a*) and 2(*b*), it is shown that a rod type compound is formed in the grain boundaries in the magnesium matrix. The magnesium matrix has a plurality of domains (grains), and the compound is formed in the domain boundaries (grain boundaries). Referring to FIGS. 2(*c*) and 2(*d*), it is shown that the intensity of aluminum and calcium is high in the rod type compound (see the bright area in FIGS. 2(*c*) and 2(*d*)). Accordingly, it is known that the rod type compound is an Al—Ca compound. This Al—Ca compound may include as $Al_2Ca$ or $Al_4Ca$. Thus, it is confirmed that Ca added into the magnesium-aluminum alloy reacts with Al to form an Al—Ca compound.

In addition, the results show that the Al—Ca compound is mainly distributed at grain boundaries of the master alloy. This is because the Ca-based compound is mostly distributed at the grain boundaries rather than within or inside of the grains (in the domains) due to the fact that the grain boundaries have the characteristic of having open structures. However, this analysis result does not limit the present embodiment such that the Ca-based compound is entirely distributed at the grain boundaries, but the Ca-based compound may be discovered at the inside of grains in some cases.

The master alloy may be added into the molten aluminum so as to form an aluminum alloy including magnesium. In some cases, the master alloy itself may be used as an alloy for special applications. For example, the aluminum master alloy formed by the afore-mentioned method can be used as an aluminum-calcium alloy. The Ca-based compound may be formed in the aluminum matrix which in turn is formed by adding Ca into pure aluminum or aluminum alloy. Ca is dissolved in the aluminum matrix up to the solubility limit.

In the case where Ca, in an amount less than the solubility limit, is added into aluminum, Ca can be dissolved in the aluminum matrix. On the other hand, where Ca, in an amount greater than the solubility limit, is added into aluminum, remnant Ca may react with aluminum to form the Ca-based alloy such as an Al—Ca compound. In another case, where Ca is added into a magnesium-aluminum alloy, the Ca-based compound may include at least one of a Mg—Ca compound, an Al—Ca compound, and a Mg—Al—Ca compound.

When the Ca-based compound is distributed at the grain boundaries or phase boundaries of the Al alloy, the average size of the grains or phase regions may be decreased by suppressing the movement of grain boundaries or phase boundaries. This is because this Ca-based compound acts as an obstacle to the movement of grain boundaries or phase boundaries. Refinement of the grains or phase regions by the Ca-based compound improves mechanical properties such as strength and elongation and so on. The Ca-based compound as an intermetallic compound has higher strength than the matrix and acts as an obstacle to the movement of dislocations, thus contributing to the increase of the strength of the alloy.

For example, Ca in an amount between 0.1 and 40% by weight may be added into the aluminium alloy. In the case where the amount of Ca is less than about 0.1% by weight, the effects of Al—Ca compound is negligible. Also, when the amount of Ca is more than about 40% by weight, the mechanical properties may be deteriorated due to the increase of brittleness. Thus, the amount of Ca may be between 10 and 30% by weight, preferably between 15 and 30% by weight, more preferably between 15 and 25% by weight.

In some cases, it is preferable to have the amount of Ca dissolved in the aluminum matrix be as low as possible. For example, when the content of Ca dissolved in the aluminum matrix is not controlled to be less than 500 ppm, the quality of the molten aluminum can become deteriorated by the occurrence of bubbles in the molten aluminum. The casting material formed by this molten aluminum may have low strength and low elongation because of micro voids resulted from the bubbles.

Also, Ca may have a reverse influence on the mechanical properties by suppressing Mg2Si formation which is important in increasing the strength of Al—Mg—Si alloy. In these cases, it is necessary to control the amount of Ca to be less than the solubility limit such as 500 ppm. When Ca is directly added into the molten aluminum, it is difficult to control the amount of Ca to be less than 500 ppm repeatedly because of the difficulty in controlling the loss of Ca precisely in the molten aluminum. If this is the case, this problem is overcome by adding Ca indirectly in the master alloy rather than directly adding Ca.

As described above, in the master alloy, a small portion of Ca is dissolved in the matrix but most of the Ca exists as the Ca-based compound. The Ca-based compound is mostly an intermetallic compound, and has a melting point higher than that (658° C.) of Al. As an example, the melting points of $Al_2Ca$ and $Al_4Ca$ as Al—Ca compounds are 1079° C. and 700° C., respectively, which are higher than the melting point of Al.

Therefore, even when the master alloy with Ca dissolved in the matrix and a Ca-based compound is added into the aluminum alloy, only a small quantity of Ca is diluted and provided in the aluminum matrix, and most of the Ca is provided in the form of the Ca-based compound. Thus, the aluminum alloy has a structure having a small quantity of Ca (such as less than 500 ppm) dissolved in the matrix and the Ca-based compound is dispersed on the matrix. Accordingly, it has been found now to simultaneously overcome problems caused when Ca is dissolved in the matrix in an amount more than 500 ppm, and also improve the mechanical properties of the alloy through the dispersion of the Ca-based compound.

As mentioned above, the Ca-based compound may be dispersed and distributed into fine particles in the Al alloy, which increases the strength of the aluminium alloy. The Al alloy according to the present invention may have grains or phase regions of finer and smaller size on average when compared to the Al alloy without this Ca-based compound. Refinement of the grains or phase regions by the Ca-based compound may bring the effects of improving strength and elongation simultaneously.

A manufacturing method of Al alloy according to an exemplary embodiment will be described in detail below. The manufacturing method may include: providing a master alloy containing a Ca-based compound and aluminum; forming a melt in which the master alloy and aluminum are melted; and casting the melt.

For example, in order to form the melt including the master alloy and melted Al, a molten Al is formed first by melting aluminum, the master alloy containing the Ca-based compound is added into the molten Al, and then melted. As another example, the melt may be formed by loading Al and Mg master alloy together in a melting apparatus such as a crucible, and heating them together.

Figure 3:
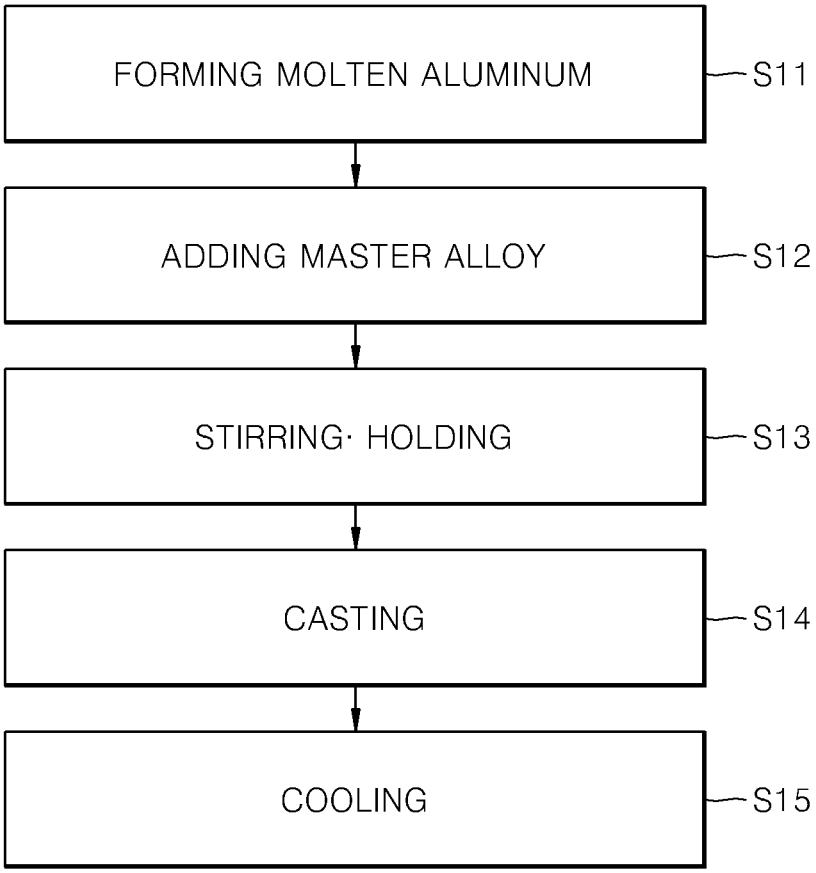
FIG. 3 is a flowchart illustrating an embodiment of a method of manufacturing an aluminum alloy according to the present invention.

FIG. 3 illustrates an exemplary embodiment of a manufacturing method of an Al alloy according to the present invention. Specifically, FIG. 3 is a flowchart illustrating a manufacturing method of an Al alloy by using a process of forming a molten aluminum first, then adding the master alloy into the molten aluminum, and melting the master alloy.

As illustrated in FIG. 3, the manufacturing method may include a molten aluminum forming operation S11, a master alloy adding operation S12, a stirring holding operation S13, a casting operation S14, and a cooling operation S15.

In the operation S11, aluminum is put into a crucible and molten Al is formed by heating the crucible at a temperature ranging between about 600° C. and about 900° C. In the operation S11, aluminum may be any one selected from pure aluminum, aluminum alloy and equivalents thereof. The Al alloy, for example, may be any one selected from 1000 series, 2000 series, 3000 series, 4000 series, 5000 series, 6000 series, 7000 series, and 8000 series wrought aluminum, or 100 series, 200 series, 300 series, 400 series, 500 series, and 700 series casting aluminum.

Herein, an aluminum alloy according to embodiments of the present invention will be described more specifically. Various types of Al alloy have been developed depending on the usage, and types of Al alloy are classified by the Standard of Aluminum Association of America, which has now been adopted by most countries. Table 1 shows various alloy series in thousands (1000 series aluminum, 2000 series aluminum, etc.) and the composition of main alloying elements for each of the identified alloy series. As shown in Table 2, below, a specific alloy can be further identified by a 4 digit number that identifies further refinements in the alloy by the addition of other improving elements to each alloy series.

TABLE 1

| Alloy series | Main alloying elements |
|---|---|
| 1000 series aluminum | Pure aluminum |
| 2000 series aluminum | Al—Cu—(Mg) series Al alloy |
| 3000 series aluminum | Al—Mn series Al alloy |
| 4000 series aluminum | Al—Si series Al alloy |
| 5000 series aluminum | Al—Mg series Al alloy |
| 6000 series aluminum | Al—Mg—Si series Al alloy |
| 7000 series aluminum | Al—Zn—Mg—(Cu) series Al alloy |
| 8000 series aluminum | The others |

The first number represents an alloy series indicating major alloying element as described above; the second number indicates a base alloy as 0 and indicates an improved alloy as the number 1 to 9; and a new alloy developed independently is given a letter of N. For example, 2xxx is a base alloy of Al—Cu series aluminium, 21xx~29xx are alloys improving Al—Cu series base alloy, and 2Nxx is a case of new alloy developed in addition to the Association Standard. The third and fourth numbers indicate purity of aluminium in the case of pure aluminium, and, in the case of an alloy, these numbers are alloy names of Alcoa Inc. used in the past. For example, in the case of pure Al, 1080 indicates that the purity of aluminium is more than 99.80% Al and 1100 indicates 99.00% Al. The main compositions of such aluminium alloys are as listed in Table 2 below.

TABLE 2

| Grade | Additive metal (%) | | | | | | | |
|---|---|---|---|---|---|---|---|---|
| number | Si | Cu | Mn | Mg | Cr | Zn | others | Uses |
| 1100 | | 0.12 | | | | | Si 1%, Fe large quantity | Thin metal plate, Kitchen utensil |
| 1350 | | | | | | | The others about 0.5% | Conductive material |
| 2008 | 0.7 | 0.9 | | 0.4 | | | | Metal plate for automobile |
| 2014 | 0.8 | 4.4 | 0.8 | 0.5 | | | | Airplane exterior, Truck frame |
| 2024 | | 4.4 | 0.6 | 1.5 | | | | Airplane exterior, Truck wheel |
| 2036 | | 2.6 | 0.25 | 0.45 | | | | Metal plate for automobile |
| 2090 | | 2.7 | | | | | Li 2.2, Zr 0.12 | Metal for airplane |
| 2091 | | 2.2 | | 1.5 | | | Li 2.0, Zr 0.12 | Metal for airplane |

TABLE 2-continued

| Grade number | Additive metal (%) Si | Cu | Mn | Mg | Cr | Zn | others | Uses |
|---|---|---|---|---|---|---|---|---|
| 2219 | | 6.3 | 0.3 | | | | V 0.1, Zr 0.18, Ti 0.06 | Metal for spacecraft, Weldable |
| 2519 | | 5.9 | 0.3 | 0.2 | | | V 0.1, Zr 0.18 | Military equipment, Metal for spacecraft, Weldable |
| 3003 | | 0.12 | 1.1 | | | | | General purpose, Kitchen utensil |
| 3004 | | | 1.1 | 1.0 | | | | General purpose, Metal can |
| 3105 | | | 0.6 | 0.5 | | | | Building material |
| 5052 | | | | 2.5 | 0.25 | | | General purpose |
| 5083 | | | 0.7 | 4.4 | 0.15 | | | Heat/pressure-resistant containers |
| 5182 | | | 0.35 | 4.5 | | | | Metal can, Metal for automobile |
| 5252 | | | | 2.5 | | | | Car body exterior use |
| 6009 | 0.8 | 0.33 | 0.33 | 0.5 | | | | Metal plate for automobile |
| 6010 | 1.0 | 0.33 | 0.33 | 0.8 | | | | Metal plate for automobile |
| 6013 | 0.8 | 0.8 | 0.33 | 1.0 | | | | Metal for spacecraft |
| 6061 | 0.6 | 0.25 | | 1.0 | 0.20 | | | General purpose |
| 6063 | 0.4 | | | 0.7 | | | | General purpose, Injection molding |
| 6201 | 0.7 | | | 0.8 | | | | Conductive material |
| 7005 | | | 0.45 | 1.4 | 0.13 | 4.5 | Zr 0.14 | Truck body, Train |
| 7075 | | 1.6 | | 2.5 | 0.25 | 5.6 | | Metal for airplane |
| 7150 | | 2.2 | | 2.3 | | 6.4 | Zr 0.12 | Metal for spacecraft |
| 8090 | | 1.3 | | 0.9 | | | Li 2.4, Zr 0.12 | Metal for spacecraft |

Next, in the operation S12, the master alloy manufactured according to the aforementioned method is added into the molten aluminum. The master alloy in the operation S12 may be added in an amount of about 0.0001 to about 30 parts by weight based on 100 parts by weight of aluminum. For example, the master alloy may be added in an ingot form. As another example, the master alloy may be added in various forms such as a powder form and granular form. The form of the master alloy and size of the master alloy may be selected properly depending on a melting condition, and this does not limit the scope of this exemplary embodiment.

During the addition of the master alloy, the dissolved Ca and the Ca-based compound contained in the master alloy is provided together into the molten aluminum. As described above, the Ca-based compound provided into the molten aluminum may include at least one of a Mg—Ca compound, an Al—Ca compound and a Mg—Al—Ca compound.

At this time, a small amount of protective gas may be additionally supplied in order to prevent the master alloy, such as Mg master alloy from being oxidized. The protective gas may use typical $SF_6$, $SO_2$, $CO_2$, HFC-134a, Novec™612, inert gas, equivalents thereof, or gas mixtures thereof, thus enabling the oxidation of the Mg master alloy to be suppressed.

However, this protective gas is not always necessary in this embodiment. That is, in the case where the Mg master alloy contains the Ca-based compound, ignition resistance is increased due to the increase in the oxidation resistance of the Mg master alloy, and the intervention of impurities such as oxide in the melt is reduced remarkably as compared to the case of addition of conventional Mg which does not contain a Ca-based compound. Therefore, according to the Al alloy manufacturing method of this embodiment, the quality of the melt may be improved significantly because the cleanliness of the molten aluminium is greatly improved even without using a protective gas.

Afterwards, in the stirring•holding operation S13, the molten aluminum may be stirred or held for an appropriate time. For example, the molten aluminum may be stirred or held for about 1 to about 400 minutes. Herein, if the stirring holding time is less than about 1 minute, the Mg master alloy is not fully mixed in the molten aluminum. On the contrary, if it is more than about 400 minutes, the stirring holding time of the molten aluminum may be lengthened unnecessarily.

After the operation S13 of stirring holding the molten aluminum is substantially completed, the molten aluminum is cast in a mold in operation S14 and the solidified aluminum alloy is separated from the mold after cooling in operation S15. Temperature of the mold in the operation S14 of casting may be in the range of from about room temperature (for example, 25° C.) to about 400° C. In the cooling operation S15, the aluminum alloy may be separated from the mold after cooling the mold to room temperature; however, the aluminum alloy may be separated even before the temperature reaches to the room temperature if the master alloy is completely solidified. Explanation about casting methods will be omitted herein since the manufacturing method of the Mg master alloy has been already described in detail.

The aluminum alloy thus formed may be any one selected from 1000 series, 2000 series, 3000 series, 4000 series, 5000 series, 6000 series, 7000 series, and 8000 series wrought aluminum, or 100 series, 200 series, 300 series, 400 series, 500 series, and 700 series casting aluminum.

As described above, since the cleanliness of the molten aluminum is improved in the case of adding the Mg master alloy containing the Ca-based compound, mechanical properties of the aluminum alloy are remarkably improved. That is, impurities such as oxides or inclusions, which may deteriorate mechanical properties, are absent in the aluminum alloy due to the improvement of cleanliness of the melt, and the occurrence of gas bubbles inside of the casted aluminum alloy is also remarkably reduced. As the interior of the aluminum alloy has a cleaner state than the conventional aluminum alloy, the aluminum alloy according to the present invention has mechanical properties superior to the conventional aluminum alloy such that it has not only excellent yield strength and tensile strength but also excellent elongation.

Therefore, although the aluminum alloy having the same amount of Mg is manufactured, the cast aluminum alloy may have good properties due to the effect of purifying the quality of the melt according to the present invention.

Also, the loss of Mg added in the melt is reduced. Accordingly, even though an actual addition amount of magnesium is smaller than the conventional method, an aluminum alloy can be economically manufactured to substantially have the same amount of magnesium as the conventional aluminum alloy.

Further, while adding the Mg master alloy into the molten aluminum, the magnesium instability in the molten aluminum is remarkably improved as compared to the conventional aluminum alloy, thus making it possible to easily increase the content of Mg compared to the conventional aluminum alloy.

Magnesium can be dissolved up to about 15 wt % maximally in aluminum, and the dissolving of Mg into Al leads to an increase in mechanical properties of the aluminum. For example, if magnesium was added to 300-series or 6000-series Al alloy, the strength and elongation of the Al alloy is improved.

However, the quality of a conventional aluminum alloy may be deteriorated since oxides and inclusions caused by Mg are immixed into the melt due to a high oxidizing potential of Mg. This problem becomes more serious as the content of Mg is greater, and thus it was very difficult to stably increase the content of Mg added into the molten aluminum although a protective gas is used.

In contrast, since the Mg master alloy may be added stably into the molten aluminum, it is possible to secure the castability while increasing the ratio of Mg by increasing Mg content in aluminum alloy easily as compared to the conventional method. Therefore, since the incorporation of oxides or inclusions is suppressed by adding the Mg master alloy into 300-series or 6000-series Al alloy, the strength and elongation of the Al alloy as well as castability may be improved, and furthermore, it is possible to use 500-series or 5000-series Al alloy which is not practically used at present.

As an example, the aluminum alloy according to the present invention may easily increase the dissolved amount of Mg up to 0.1 wt % or more, and also increase the dissolved amount of Mg up to 5 wt % or more, further up to 6 wt % or more, and even further up to the solubility limit of 15 wt % from 10 wt % or more.

The stability of Mg in the aluminum alloy may act favorably during recycling of aluminum alloy waste. For example, in the case where Mg content is high during the process of recycling the waste for manufacturing an aluminum alloy, a process (hereinafter, referred to as 'demagging process') for reducing the Mg content to the required ratio is performed. The degree of difficulty and cost of the demagging process are increased as the ratio of required Mg content is lowered.

For example, in the case of 383 Al alloy, it is technically easy to reduce the Mg content up to 0.3 wt %, but it is very difficult to reduce the Mg content up to 0.1 wt %. Also, chlorine gas ($Cl_2$) is used for reducing the ratio of Mg; however, the use of chlorine gas is harmful to the environment, thus leading to an increase in cost.

However, there are technical, environmental and cost advantages since the aluminum alloy, which is manufactured using the Mg master alloy containing the Ca-based compound according to the present invention, enables to maintain the Mg ratio more than 0.3 wt %.

Also, the aluminum alloy according to the present invention may further include an operation of adding a small amount of iron (Fe) during the above-described manufacturing process, for example, after the operation S11 of forming the molten aluminum or the operation S12 of adding the Mg master alloy. The added amount of Fe may be smaller when compared to the conventional method. That is, in the case of casting an aluminum alloy conventionally, for example, in the case of die-casting an aluminum alloy, a problem of damaging a die often occurred due to soldering between a die made of an iron-based metal and an Al casting material. In order to solve such a problem, about 1.0 to about 1.5% by weight of Fe has been added into an aluminum alloy during the die-casting of the aluminum alloy from the past. However, the addition of Fe may create another problem of deteriorating the corrosion resistance and elongation of the aluminum alloy.

However, the aluminum alloy according to the present invention may contain Mg at a high ratio, and the soldering problems typically associated with conventional die-casted Al alloy case material may be significantly improved even though a considerably small ratio of Fe as compared to the conventional alloy is added. Therefore, it is possible to solve the problem of a decrease in corrosion resistance and elongation, which occurs in the conventional die-casted Al alloy cast material.

The content of Fe added in the process of manufacturing the Al alloy may be less than or equal to about 1.0% by weight (more than 0%) with respect to Al alloy, and more strictly be less than or equal to about 0.2% by weight. Therefore, Fe with the corresponding composition range may be contained in the matrix of the Al alloy.

The characteristics of the Al alloy manufactured according to the manufacturing method of the present invention will be described in detail below. The Al alloy manufactured according to the manufacturing method of the present invention contains an Al matrix and a Ca-based compound existing in the Al matrix, wherein an amount of Ca dissolved in the Al matrix is less than the solubility limit, for example less than 500 ppm.

The Al matrix may have a plurality of domains which form boundaries therebetween and are divided from each other, and the Ca-based compound may exist at the boundaries or inside the domains. The Al matrix may be defined as a metal structure body in which Al is a major component and other alloying elements are dissolved or other compound except that the Ca-based compound is formed as a separate phase.

The plurality of domains divided from each other may be a plurality of grains typically divided by grain boundaries, or may be a plurality of phase regions having two or more different phases, which are defined by phase boundaries.

The Al alloy according to the present invention can improve the mechanical properties in virtue of the Ca-based compound formed in the master alloy. As already described above, when the master alloy is added into the molten aluminium, the Ca-based compound contained in the master alloy is also added into the molten aluminium. The Ca-based compound is an intermetallic compound which is formed by reacting Ca with other metal elements and has higher melting points than Al.

Therefore, in the case where the master alloy containing such a Ca-based compound is inputted to the molten aluminium, the Ca-based compound may be maintained inside of the melt without being melted. Moreover, in the case of manufacturing the Al alloy by casting such molten aluminium, the Ca-based compound may be included in the Al alloy.

The Ca-based compound may be dispersed and distributed into fine particles in the Al alloy. The Ca-based compound, as an intermetallic compound, is a high strength material as compared to Al which is a matrix, and therefore, the strength of the Al alloy may be increased due to the dispersive distribution of such a high strength material.

Meanwhile, the Ca-based compound provides sites where nucleation occurs during the phase transition of the Al alloy from a liquid phase to a solid phase. That is, the phase transition from the liquid phase to the solid phase during solidification of aluminium alloy will be carried out through nucleation and growth. Since the Ca-based compound itself acts as a heterogeneous nucleation site, nucleation for phase transition to the solid phase is initiated at the interface between the Ca-based compound and the liquid phase. The solid phase nucleated like this grows around the Ca-based compound.

In the case where the Ca-based compound is distributed in a dispersive way, solid phases growing at the interface of the respective Ca-based compound meet each other to form boundaries, and these boundaries may form grain boundaries or phase boundaries. Therefore, if a Ca-based compound functions as a nucleation site, the Ca-based compound exists inside of grains or phase regions, and the grains or phase regions become finer as compared to the case where the Ca-based compound is not present.

Also, the Ca-based compound are distributed at the grain boundaries between grains or the phase boundaries between phase regions. This is because such boundaries are further opened and have relatively high energy compared to inside regions of the grains or phase regions, and therefore provide a favorable site for nucleation and growth of the Ca-based compound.

Thus, in the case where the Ca-based compound is distributed at the grain boundaries or phase boundaries of Al alloy, an average size of the grains or phase regions may be decreased by suppressing the movement of grain boundaries or phase boundaries due to the fact that this Ca-based compound acts as an obstacle to the movement of grain boundaries or phase boundaries.

Therefore, the Al alloy according to the present invention may have grains or phase regions finer and smaller size on average when compared to the Al alloy without a Ca-based compound. Refinement of the grains or phase regions due to the Ca-based compound may improve the strength and elongation of the alloy simultaneously.

Also, the aluminum matrix may be any one selected from 1000 series, 2000 series, 3000 series, 4000 series, 5000 series, 6000 series, 7000 series, and 8000 series wrought aluminum or 100 series, 200 series, 300 series, 400 series, 500 series, and 700 series casting aluminum.

Hereinafter, experimental examples will be provided in order to help understanding of the present invention. The experimental examples described below are only for helping to understand the present invention and the present invention is not limited by the experimental examples below.

Table 3 shows cast properties comparing an Al alloy manufactured by adding a master alloy manufactured with addition of calcium into aluminum (Experimental example 1) and an Al alloy manufactured by adding pure Mg without addition of calcium in aluminum (Comparative example 1). The master alloy used in the experimental example 1 employs a Mg—Al alloy as a parent material, and the weight ratio of calcium with respect to parent material was 0.3.

Specifically, Al alloy of the experimental example 1 was manufactured by adding 305 g of Mg master alloy into 2750 g of Al, and Al alloy of the comparative example 1 was manufactured by adding 305 g of pure Mg into 2750 g of Al.

TABLE 3

| | Experimental example 1 | Comparative example 1 |
|---|---|---|
| Dross amount (impurity floating on the melt surface) | 253 g | 510 g |

TABLE 3-continued

| | Experimental example 1 | Comparative example 1 |
|---|---|---|
| Mg content in Al alloy | 4.02% | 2.65% |
| Melt fluidity | Good | Bad |
| Hardness (HR load 60 kg, 1/16" steel ball) | 92.2 | 92 |

Referring to Table 3, it has been shown that the amount of impurity floating on the melt surface (amount of Dross) represents remarkably smaller value when adding the Mg master alloy (experimental example 1) than when adding pure Mg (comparative example 1). Also, it was shown that the Mg content in aluminum alloy is larger when adding the Mg master alloy (experimental example 1) than when adding pure Mg (comparative example 1). Hence, it was shown that the loss of Mg is decreased remarkably in the case of the manufacturing method of the present invention as compared to the method of adding pure Mg.

Also, the fluidity of the melt and hardness of Al alloy were found to be better when the Mg master alloy was added (experimental example 1) than when pure Mg was added (comparative example 1).

Figure 4:
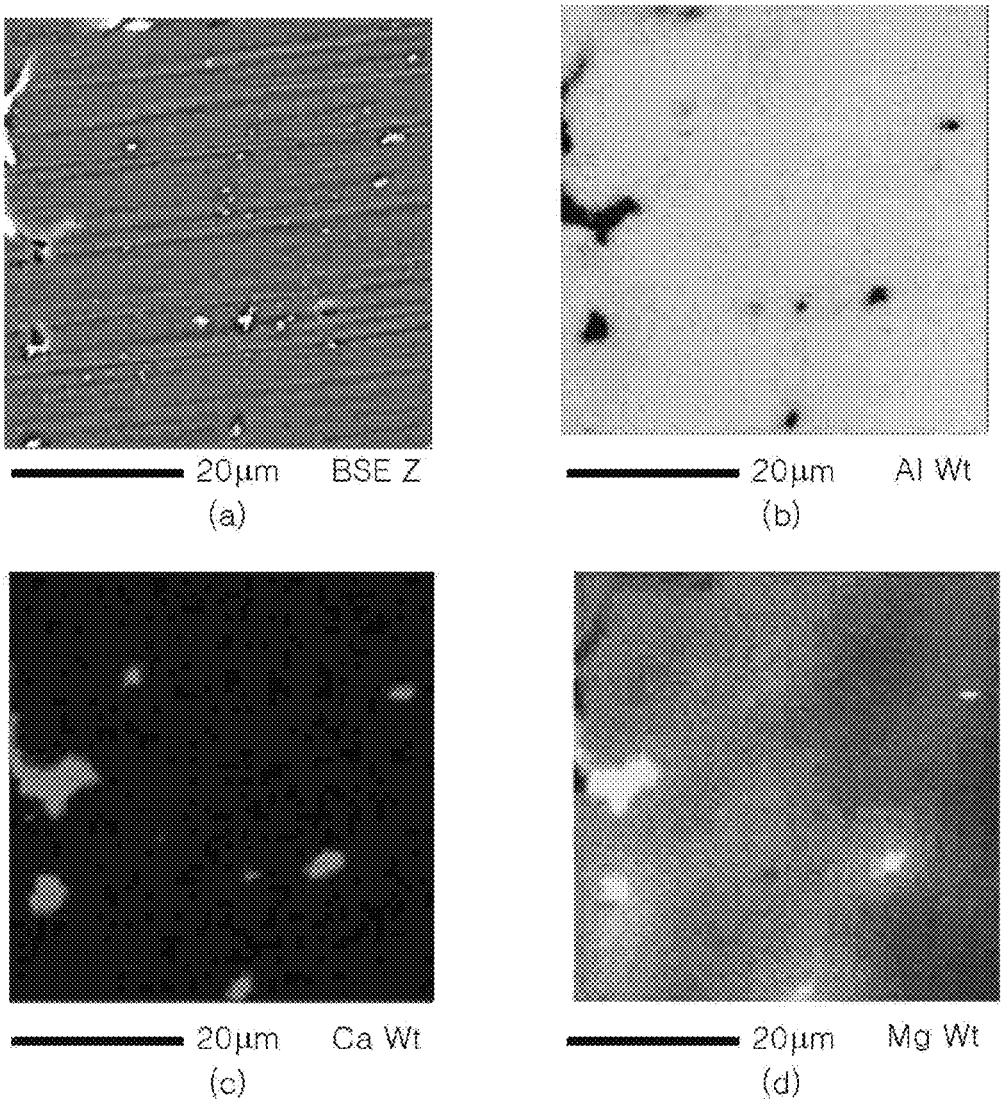
FIG. 4 shows analysis results of components of an aluminum alloy with a magnesium master alloy including a Ca added according to an example embodiment of the present invention.

FIG. 4(*a*) shows the EPMA observation result of microstructure of Al alloy of the experimental example 1, and FIGS. 4(*b*) through 4(*d*) shows the respective mapping results of Al, Ca and Mg using EPMA.

Referring to FIGS. 4(*b*) through 4(*d*), Ca, Mg and Al are detected at the same position in Al matrix, and thus it is shown that Ca reacts with Mg and Al to form a Ca-based compound.

Figure 5:
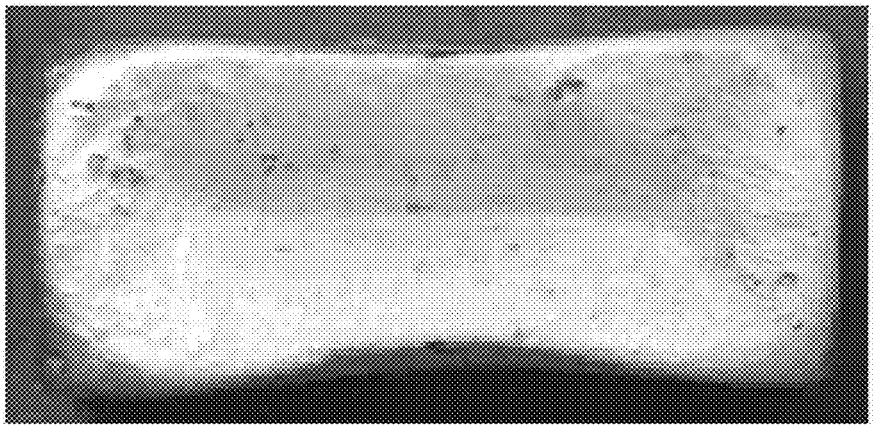
FIG. 5 shows surface images of a casting material for an aluminum alloy in which a master alloy was prepared by adding Ca according to an example embodiment of the present invention (a); and a casting material for an aluminum alloy into which pure magnesium is added (b).
Figure 5:
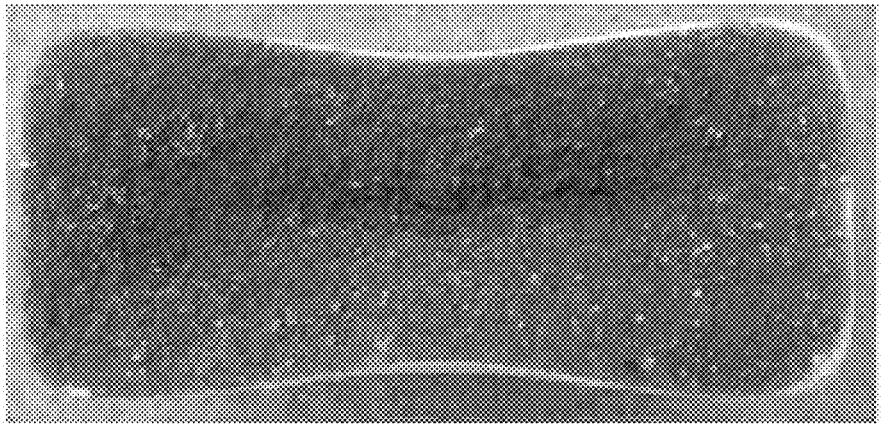

FIG. 5 shows comparison results of the cast material surfaces of Al alloys that were prepared according to experimental example 1 and comparative example 1.

Referring to FIG. 5, it may be confirmed that the surface of Al alloy casting material with the Mg master alloy of the experimental example 1 added as shown in (a) is cleaner than that of the Al alloy casting material with pure Mg of the comparative example 1 added as shown in (b). This is due to the fact that castability is improved by calcium added into the Mg master alloy. That is, the Al alloy with pure Al added (comparative example 1) shows ignition marks on the surface due to pure Mg oxidation during casting, however, clean surface of an aluminum alloy may be obtained due to suppression of ignition phenomenon in the Al alloy casted using the Mg master alloy with calcium added (experimental example 1). Hence, it was observed that castability was improved by improvement of quality of the melt in the case of adding Mg master alloy as compared to the case of adding pure Mg.

Table 4 shows the mechanical properties comparing Al alloy (experimental example 2 and 3) manufactured by adding the Mg master alloy, in which calcium was added to 6061 alloy as commercially available Al alloy, with 6061 alloy (comparative example 2). A sample according to experimental example 2 is extruded after casting, and T6 heat treatment was performed, and data of comparative example 2 refer to the values (T6 heat treatment data) in ASM standard.

TABLE 4

| | Tensile strength (MPa) | Yield strength (MPa) | Elongation (%) |
|---|---|---|---|
| Experimental example 2 | 361 | 347 | 18 |
| Comparative example 2 | 310 | 276 | 17 |

As listed in Table 4, it was shown that the aluminum alloy of experimental example 2 represents higher values in tensile strength and yield strength while also exhibiting superior or identical values in elongation when compared to the commercially available Al alloy of comparative example 2. In general, elongation will be decreased relatively in the case where strength is increased in alloy. However, Al alloys according to the present invention show an ideal property that elongation is also increased together with an increase in strength. As was described above, this result may be related to improvement in the cleanliness of the Al alloy melt.

Figure 6:
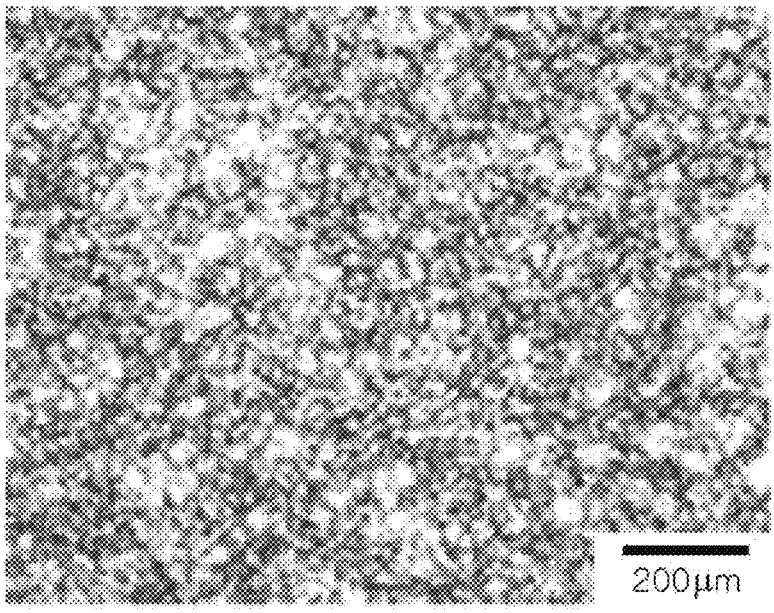
FIG. 6 shows observation results on a microstructure of an aluminum alloy manufactured by adding a magnesium master alloy with Ca added into alloy 6061 (a), and a microstructure of alloy 6061 which is commercially available (b).
Figure 6:
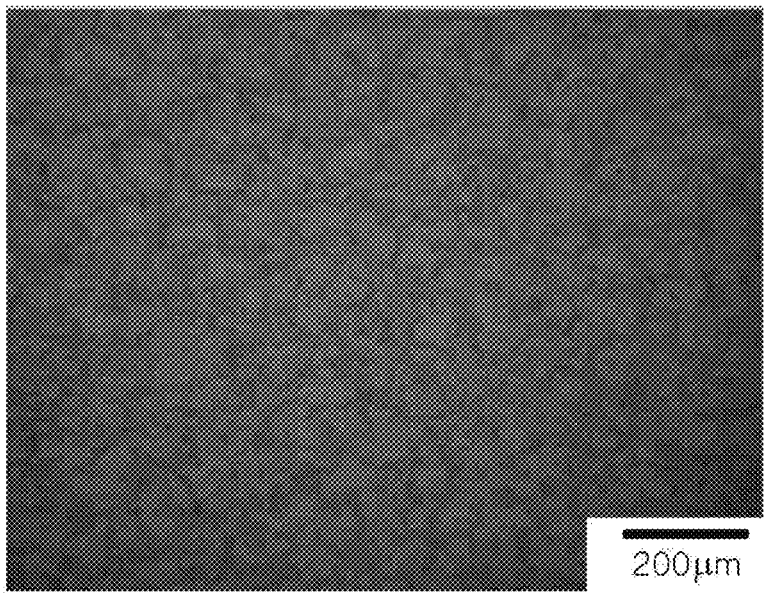

FIG. 6 represents the observation result of microstructures of alloys prepared according to experimental example 2 and comparative example 2. Referring to FIG. 6, it was shown that grains of Al alloy of experimental example 2 as shown in (a) were exceptionally refined as compared to a commercial Al alloy of comparative example 2 as shown in (b).

Grain refinement in the Al alloy of the experimental example 2 is attributed to the fact that growth of grain boundaries was suppressed by the Ca-based compound distributed at grain boundaries or the Ca-based compound functioned as nucleation sites during solidification. It is believed that such grain refinement is one of the reasons why the Al alloy according to the present invention shows superior mechanical properties.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing an aluminum (Al)-based alloy, the method comprising:

providing an aluminum alloy;

providing a master alloy including Mg, Al and Ca, wherein the master alloy is formed by providing a parent material of magnesium alloy that has aluminum as an alloying element, and subsequently adding calcium (Ca) into the parent material, and subsequently forming a melt in which the master alloy and aluminum are melted; and casting the melt to form the aluminum-based alloy that includes the calcium from the master alloy.

2. The method of claim 1, further comprising adding iron (Fe) in an amount less than or equal to about 1.0% by weight and greater than 0%.

3. The method of claim 2, wherein the iron (Fe) is added in an amount less than or equal to about 0.2% by weight.

4. The method of claim 1, wherein the master alloy is provided in an amount between about 0.0001 and about 30 parts by weight based on 100 parts by weight of the aluminum.

5. The method of claim 1, wherein the calcium is added in an amount between about 0.0001 and about 100 parts by weight based on 100 parts by weight of the parent material.

6. The method of claim 5, wherein the calcium is added in an amount more than a solubility limit and less than or equal to about 100 parts by weight based on 100 parts by weight of the parent material.

7. The method of claim 1, wherein forming the melt comprises:

forming a molten aluminum by melting the aluminum;

adding the master alloy into the molten aluminum; and melting the master alloy.

8. The method of claim 1, wherein forming the melt comprises:

melting the master alloy and the aluminum together.

9. The method of claim 1, wherein forming the master alloy comprises:

forming a molten parent material by melting the parent material; and adding the calcium into the molten parent material.

10. The method of claim 1, wherein forming the master alloy comprises:

melting the parent material and the calcium together.

11. The method of claim 1, wherein a calcium-based compound is formed by reacting the calcium with magnesium or aluminum, or both of the parent material.

12. The method of claim 11, wherein the calcium-based compound comprises at least one of a Mg—Ca compound, an Al—Ca compound and a Mg—Al—Ca compound.

13. The method of claim 12, wherein the Mg—Ca compound comprises $Mg_2Ca$.

14. The method of claim 12, wherein the Al—Ca compound comprises at least one of $Al_2Ca$ and $Al_4Ca$.

15. The method of claim 12, wherein the Mg—Al—Ca compound comprises $(Mg, Al)_2Ca$.

16. The method of claim 1, wherein the aluminum is pure aluminum or an aluminum alloy.

17. The method of claim 1, wherein the master alloy is provided in an ingot form, a powder form, or a granular form.

18. The method of claim 9, wherein forming the master alloy further comprises:

casting a melt including the molten parent material and the added calcium; and cooling the melt to form the master alloy.

19. The method of claim 1, wherein the calcium is added in an amount between about 10% and 30% by weight.

20. The method of claim 1, wherein the calcium in the aluminum-based alloy is present in an amount that is less than a solubility limit of the aluminum-based alloy.

21. The method of claim 1, wherein the melt includes about 0.0001 to about 30 parts by weight of the master alloy based on 100 parts by weight of the aluminum.

22. The method of claim 1, wherein the calcium from the master alloy is in the form of an intermetallic compound.

* * * * *